US010480844B2

(12) United States Patent
Broadbent

(10) Patent No.: US 10,480,844 B2
(45) Date of Patent: Nov. 19, 2019

(54) DRAINING THE SUMP OF AN ICE MAKER TO PREVENT GROWTH OF HARMFUL BIOLOGICAL MATERIAL

(71) Applicant: True Manufacturing Co., Inc., O'Fallon, MO (US)

(72) Inventor: John Allen Broadbent, Denver, CO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 86 days.

(21) Appl. No.: 14/829,872

(22) Filed: Aug. 19, 2015

(65) Prior Publication Data

US 2016/0054043 A1 Feb. 25, 2016

Related U.S. Application Data

(60) Provisional application No. 62/040,456, filed on Aug. 22, 2014.

(51) Int. Cl.
*F25C 1/00* (2006.01)
*F25C 1/25* (2018.01)
(Continued)

(52) U.S. Cl.
CPC ..... *F25C 1/25* (2018.01); *F25C 1/147* (2013.01); *F25C 5/187* (2013.01); *F25C 2400/12* (2013.01); *F25C 2700/04* (2013.01)

(58) Field of Classification Search
CPC ..... F25C 1/225; F25C 2400/12; F25C 1/22; F25C 1/12; F25C 1/04; F25C 1/08;
(Continued)

(56) References Cited

U.S. PATENT DOCUMENTS 3,080,726 A 3/1963 Tenniswood
3,254,501 A 6/1966 Brysselbout
(Continued)

FOREIGN PATENT DOCUMENTS

JP 56162016 A * 12/1981 ..... G01F 23/16
JP S5785170 U 5/1982
(Continued)

OTHER PUBLICATIONS

Patent Cooperation Treaty, International Search Report for PCT/US15/45809, dated Nov. 26, 2015, 3 pages.
(Continued)

*Primary Examiner* — Ljiljana V. Ciric
*Assistant Examiner* — Alexis K Cox
(74) *Attorney, Agent, or Firm* — Stinson LLP

(57) ABSTRACT

An ice maker having a refrigeration system, a water system and a control system. The refrigeration system includes an ice formation device. The water system supplies water to the ice formation device, and includes a water reservoir (e.g., a sump or float chamber) for holding water to be formed into ice and a discharge valve in fluid communication with the water reservoir. The control system includes an ice level sensor adapted to sense the ice level in an ice storage bin, and a controller adapted to cause water to drain from the water reservoir when the ice storage bin is full. Substantially or all of the water remaining in the water reservoir is drained such that while the ice maker is not making ice the water reservoir is empty of water.

7 Claims, 10 Drawing Sheets

(51) Int. Cl.
*F25C 1/147* (2018.01)
*F25C 5/187* (2018.01)

(58) Field of Classification Search
CPC ..... F25C 1/00; F25C 3/00; F25C 5/00; F25C 2300/00; F25C 2301/00; F25C 2303/00; F25C 2305/00; F25C 2400/00
USPC ..... 62/66, 135
See application file for complete search history.

(56) References Cited

U.S. PATENT DOCUMENTS 3,407,621 A 10/1968 Dedricks et al.
4,341,087 A 7/1982 Van Steenburgh et al.
4,459,824 A 7/1984 Krueger et al.
5,440,892 A * 8/1995 Tatematsu ..... F25C 1/147 62/135
5,477,694 A 12/1995 Black et al.
5,479,707 A 1/1996 Alvarez et al.
5,752,393 A 5/1998 Schlosser et al.
6,000,228 A 12/1999 Johnson et al.
6,101,833 A * 8/2000 Suzuki ..... F25C 1/00 249/114.1
6,324,863 B1 12/2001 Henry
6,619,051 B1 9/2003 Kilawee et al.
7,082,782 B2 8/2006 Schlosser et al.
7,269,960 B2 9/2007 Elsom et al.
7,284,391 B2 10/2007 Miller et al.
8,082,742 B2 12/2011 Broadbent et al.
2003/0010054 A1* 1/2003 Esch ..... A47F 3/0439 62/354
2003/0046942 A1* 3/2003 Shedivy ..... F25C 1/12 62/71
2003/0089120 A1 5/2003 Kampert et al.
2006/0026985 A1* 2/2006 Hollen ..... F25C 1/04 62/340
2006/0272340 A1* 12/2006 Petrenko ..... F25C 1/12 62/73
2007/0089451 A1* 4/2007 Lee ..... F25C 1/12 62/352
2007/0157636 A1* 7/2007 Billman ..... F25C 1/12 62/73
2008/0264082 A1* 10/2008 Tikhonov ..... F25C 1/04 62/137
2010/0101244 A1* 4/2010 Yoshida ..... F25C 5/187 62/66
2010/0313524 A1 12/2010 Pape et al.
2010/0326093 A1* 12/2010 Watson ..... F25B 7/00 62/66
2012/0031126 A1 2/2012 Zhang et al.
2014/0208781 A1 7/2014 Broadbent
2016/0054043 A1 2/2016 Broadbent

FOREIGN PATENT DOCUMENTS

JP S59107172 A 6/1984
JP 10253209 A 9/1998
JP 2002295933 A 10/2002
JP 2003021441 A 1/2003
JP 2003130507 A 5/2003
JP 2005016798 A 1/2005
JP 2005106448 A 4/2005
KR 1020040085284 10/2004
KR 1020090004163 1/2009
KR 20120045362 A 5/2012

OTHER PUBLICATIONS

European Patent Office, Extended European Search Report issued for App. No. 15834551.2; Pub. No. 3183517, 7 pages Feb. 23, 2018.

* cited by examiner

DRAINING THE SUMP OF AN ICE MAKER TO PREVENT GROWTH OF HARMFUL BIOLOGICAL MATERIAL

CROSS-REFERENCE TO RELATED APPLICATIONS

This application claims priority to U.S. Provisional App. No. 62/040,456, filed on Aug. 22, 2014, entitled "Draining the Sump of an Ice Maker to Prevent Growth of Harmful Biological Material," the contents of which are incorporated herein by reference in their entirety.

FIELD OF THE INVENTION

This invention relates generally to automatic ice making machines and, more particularly, to ice making machines comprising systems and employing methods which permit for emptying the liquid water from the water reservoir (e.g., sump or float chamber) of the ice making machine when the ice storage bin of the ice making machine becomes full.

BACKGROUND OF THE INVENTION

Ice making machines, or ice makers, that produce cube-, flake- or nugget-type (i.e., compressed flake) ice are well known and in extensive use. Such machines have received wide acceptance and are particularly desirable for commercial installations such as restaurants, bars, hotels, healthcare facilities and various beverage retailers having a high and continuous demand for fresh ice.

Ice makers are typically mounted on top of ice storage bins. Ice produced by ice makers is stored in the ice storage bins until the ice is removed for use. Typical ice makers stop producing ice when the ice storage bin is full. Accordingly, the refrigeration systems of typical ice makers is turned off and any water remaining in the water reservoir (e.g., sump or float chamber) of the ice maker may begin to warm up. If the ice storage bin remains full for a long period of time, such that the ice maker remains turned off for a long period of time, harmful bacteria, parasites, organisms, and/or other biological material can begin to grow in the sump of the ice maker.

SUMMARY OF THE INVENTION

Briefly, therefore, one embodiment of the invention is directed to an ice maker comprising a refrigeration system comprising a compressor, and an ice formation device. The ice maker further includes a water system for supplying water to the ice formation device, the water system comprising a water reservoir (e.g., sump or float chamber) adapted to hold water to be formed into ice and a discharge valve in fluid communication with the water reservoir. Additionally, the ice maker has a control system comprising an ice level sensor adapted to sense whether an ice storage bin is full, and a controller adapted to cause water to drain from the ice maker based upon an indication from the ice level sensor that the ice storage bin is full. The controller can cause the discharge valve to open to drain the water reservoir of all or substantially all of the water remaining in the water reservoir when the ice storage bin is full. This reduces and/or prevents the growth of harmful bacteria, parasites, organisms, and/or other biological material in the ice maker.

Another embodiment of the invention is a method of controlling an ice maker. The ice maker includes a refrigeration system comprising a compressor and an ice formation device. The ice maker further includes a water system for supplying water to the ice formation device, wherein the water system comprises a water reservoir adapted to hold water to be formed into ice and a discharge valve. Additionally, the ice maker includes a control system comprising an ice level sensor adapted to sense whether the ice storage bin is full, and a controller adapted to control the operation of the refrigeration system and the water system. The method comprises the steps of (i) receiving, by the controller, an indication from the ice level sensor that the ice storage bin is full of ice; (ii) causing, by the controller, the compressor to turn off; and (iii) causing, by the controller, the discharge valve to open to drain water from the water reservoir.

Yet another embodiment of the invention is a method of controlling an ice maker. The ice maker includes a refrigeration system comprising a compressor and an ice formation device. The ice maker further includes a water system for supplying water to the ice formation device, wherein the water system comprises a water reservoir adapted to hold water to be formed into ice and a discharge valve. Additionally, the ice maker includes a control system comprising an ice level sensor adapted to sense whether the ice storage bin is full, a water level sensor adapted to sense a water level in the water reservoir, and a controller adapted to control the operation of the operation of the refrigeration system and the water system. The method comprises the steps of (i) receiving, by the controller, an indication from the ice level sensor that the ice storage bin is full of ice; (ii) causing, by the controller, the discharge valve to open to drain water from the water reservoir; (iii) receiving, by the controller, an indication from the water level sensor that the water reservoir is empty; and (iv) causing, by the controller, the discharge valve to close after receiving, by the controller, the indication from the water level sensor that the water reservoir is empty.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

Like reference numerals indicate corresponding parts throughout the several views of the drawings.

DETAILED DESCRIPTION

Figure 1:
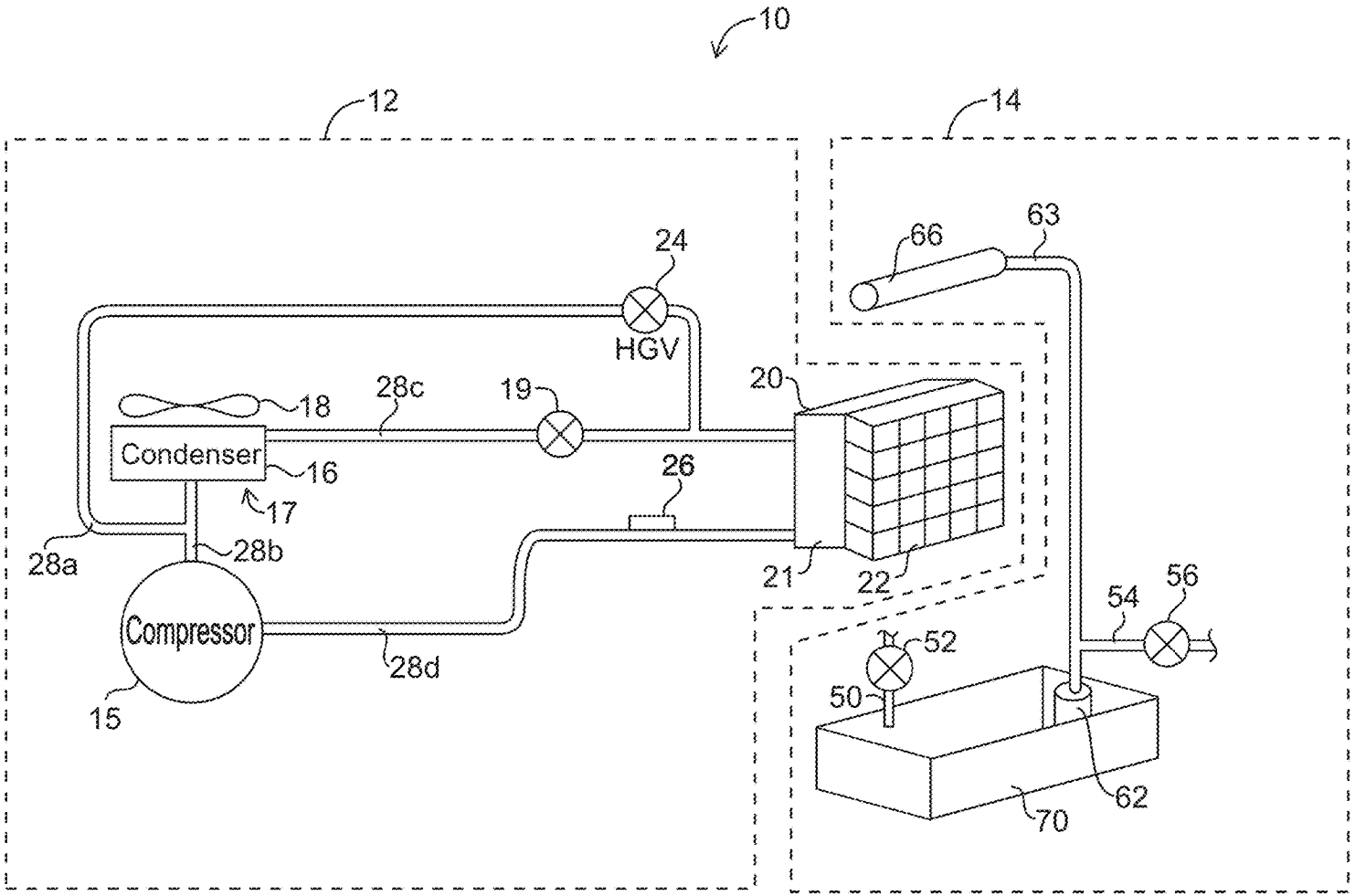
FIG. 1 is a schematic drawing of an ice maker having various components according to a first embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an invention disclosed herein or its components to any one positional or spatial orientation.

Typical ice makers have internal reservoirs for holding an amount of water, some or all of which is frozen into ice by the ice maker. In ice makers that form cube ice, the water used for ice making is circulated through the water reservoir (also referred to as a sump or trough) and over a cooled freeze plate during ice making. Accordingly, the temperature of the circulated water is reduced to about to 32° F. When the ice machine is turned off, any water remaining in the sump is no longer circulated or refrigerated. Therefore, the temperature of the water in the sump rises and the water will become stagnant. In ice makers that form flake or nugget ice, the water reservoir (also referred to as a float chamber) is filled with incoming water and is not refrigerated. During ice making, there is a steady flow of water supplied to the ice maker which is formed into ice in an ice making chamber. When the ice maker turns off, any water remaining in the float chamber and the ice making chamber is not refrigerated. Therefore, the temperature of the water in the float chamber and ice making chamber rises and the water becomes stagnant. Both cube-type ice makers and flake/nugget-type ice makers typically discharge the produced ice into an ice storage bin. When the ice storage bin of such ice makers is full, the refrigeration system is turned off, thus the refrigeration and freezing of water in the ice makers stops. Any water remaining in the ice makers can therefore warm up to the ambient air temperature where the ice maker is located.

Depending on how often ice is removed from the ice storage bin, liquid water can remain in typical ice makers for extended periods of time. Consequently, the warm, stagnant water remaining in typical ice makers can foster the growth of harmful bacteria, parasites, organisms, and/or other biological material. When the level of ice is reduced in the ice storage bin of typical ice makers, the refrigeration system is turned back on and the production of ice resumes. The water that remained in the ice maker is then used, along with fresh supplied water, to produce ice. Therefore, ice can be produced which includes the harmful bacteria, parasites, organisms, and/or other biological material. That is, such material is encapsulated in the ice, thereby contaminating the ice. Such contaminated ice, if consumed, can be hazardous to the health of humans and other animals.

One particular harmful bacterium is *Legionella* which is known to grow in warm water. While an ice maker is producing ice, the water in the ice maker is typically cold and recirculating through the ice maker and it is unlikely that *Legionella* would grow in such conditions. However, when the ice maker turns off because the ice storage bin is full of ice, the water remaining in the ice maker warms up and become stagnant. Such conditions are well suited for the growth of *Legionella*.

The production of contaminated ice can be a particular problem in hospitals, nursing homes, and other healthcare facilities where ice is often consumed by patients with weakened or compromised immune systems. The consumption of contaminated ice by such persons can be hazardous and/or fatal.

Accordingly, embodiments of the ice maker described herein drain all or substantially all of the remaining water in the ice maker when the ice storage bin becomes full. By draining all or substantially all of the water, there is little or no water which can warm up while the refrigeration system of the ice maker is off. This greatly reduces or eliminates the possibility for harmful bacteria, parasites, organisms, and/or other biological material to grow in the sump while the ice maker is not producing ice.

Cube-Type Ice Maker

FIG. 1 illustrates certain principal components of one embodiment of ice maker 10 having a refrigeration system 12 and water system 14. The refrigeration system 12 of ice maker 10 may include compressor 15, heat rejecting heat exchanger 17, refrigerant expansion device 19 for lowering the temperature and pressure of the refrigerant, ice formation device 20, and hot gas valve 24. As shown, it will be understood that heat rejecting heat exchanger 17 may be condenser 16 for condensing compressed refrigerant vapor discharged from the compressor 15. However, in other embodiments, for example, in refrigeration systems that utilize carbon dioxide refrigerants where the heat of rejection is trans-critical, heat rejecting heat exchanger 17 is able to reject heat from the refrigerant without condensing the refrigerant. Ice formation device 20 may include evaporator 21 and freeze plate 22 thermally coupled to evaporator 21. Evaporator 21 is constructed of serpentine tubing (not shown) as is known in the art. In certain embodiments, freeze plate 22 may contain a large number of pockets (usually in the form of a grid of cells) on its surface where water flowing over the surface can collect. Hot gas valve 24 may be used to direct warm refrigerant from compressor 15 directly to evaporator 21 to remove or harvest ice cubes from freeze plate 22 when the ice has reached the desired thickness.

Refrigerant expansion device 19 may include, but is not limited to, a capillary tube, a thermostatic expansion valve or an electronic expansion valve. In certain embodiments, where refrigerant expansion device 19 is a thermostatic expansion valve or an electronic expansion valve, ice maker 10 may also include a temperature sensor 26 placed at the outlet of the evaporator 21 to control refrigerant expansion device 19. In other embodiments, where refrigerant expansion device 19 is an electronic expansion valve, ice maker 10 may also include a pressure sensor (not shown) placed at the outlet of the evaporator 21 to control refrigerant expansion device 19 as is known in the art. In certain embodiments that utilize a gaseous cooling medium (e.g., air) to provide condenser cooling, a condenser fan 18 may be positioned to blow the gaseous cooling medium across condenser 16. As described more fully elsewhere herein, a form of refrigerant cycles through these components via refrigerant lines 28*a*, 28*b*, 28*c*, 28*d*.

The water system 14 of ice maker 10 includes water pump 62, water line 63, water distributor 66 (e.g., manifold, pan, tube, etc.), and water reservoir or sump 70 located below freeze plate 22 adapted to hold water. During operation of ice maker 10, as water is pumped from sump 70 by water pump 62 through water line 63 and out of water distributor 66, the water impinges on freeze plate 22, flows over the pockets of freeze plate 22 and freezes into ice. Sump 70 may be positioned below freeze plate 22 to catch the water coming off of freeze plate 22 such that the water may be recirculated by water pump 62. Water distributor 66 may be the water distributors described in copending U.S. Patent Application Publication No. 2014/0208792 to Broadbent, filed Jan. 29, 2014, the entirety of which is incorporated herein by reference.

Water system 14 of ice maker 10 further includes water supply line 50 and water inlet valve 52 disposed thereon for filling sump 70 with water from a water source (not shown), wherein some or all of the supplied water may be frozen into ice. Water system 14 of ice maker 10 further includes discharge line 54 and discharge valve 56 (e.g., purge valve, drain valve) disposed thereon. Water and/or any contaminants remaining in sump 70 after ice has been formed may be discharged via discharge line 54 and discharge valve 56. In various embodiments, discharge line 54 may be in fluid communication with water line 63. Accordingly, water in sump 70 may be discharged from sump 70 by opening discharge valve 56 when water pump 62 is running. As described more fully elsewhere herein, when discharge valve 56 is opened and water pump 62 is turned on, all or substantially all of the water in sump 70 can be removed from ice maker 10 when an ice storage bin is full.

Figure 2:
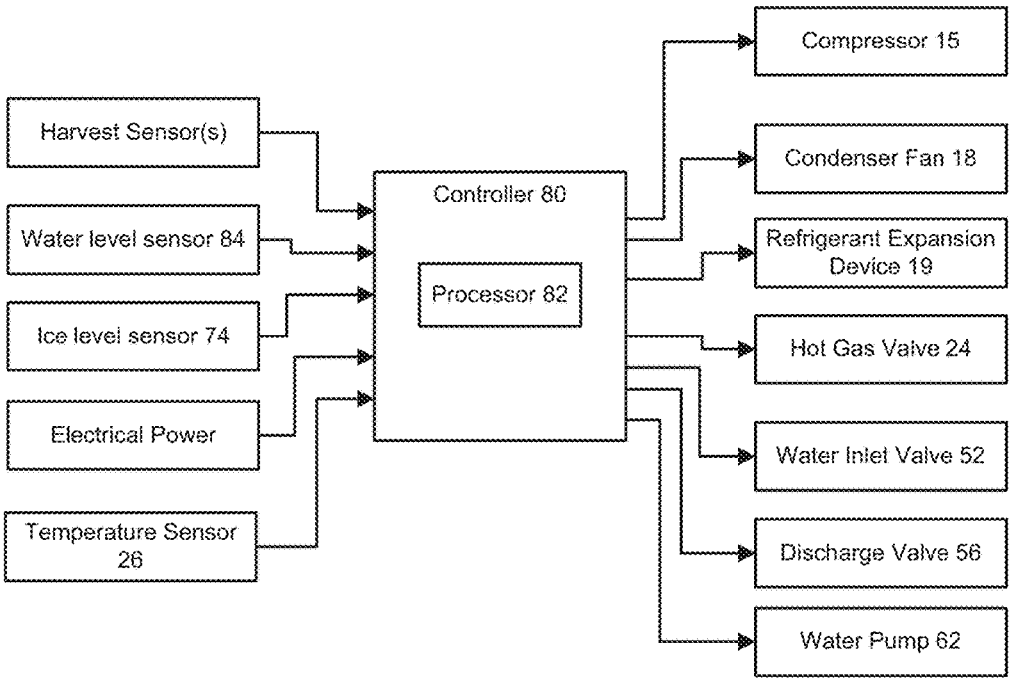
FIG. 2 is a schematic drawing of a controller for controlling the operation of the various components of an ice maker according to the first embodiment of the invention.

Referring now to FIG. 2, ice maker 10 may also include a controller 80. Controller 80 may be located remote from ice making device 20 and sump 70. Controller 80 may include a processor 82 for controlling the operation of ice maker 10 including the various components of refrigeration system 12 and water system 14. Processor 82 of controller 80 may include a non-transitory processor-readable medium storing code representing instructions to cause processor 82 to perform a process. Processor 82 may be, for example, a commercially available microprocessor, an application-specific integrated circuit (ASIC) or a combination of ASICs, which are designed to achieve one or more specific functions, or enable one or more specific devices or applications. In yet another embodiment, controller 80 may be an analog or digital circuit, or a combination of multiple circuits. Controller 80 may also include one or more memory components (not shown) for storing data in a form retrievable by controller 80. Controller 80 can store data in or retrieve data from the one or more memory components.

In various embodiments, controller 80 may also comprise input/output (I/O) components (not shown) to communicate with and/or control the various components of ice maker 10. In certain embodiments, for example controller 80 may receive inputs such as, for example, one or more indications, signals, messages, commands, data, and/or any other information, from a water reservoir water level sensor 84 or system (see FIG. 3), a harvest sensor for determining when ice has been harvested (not shown), an electrical power source (not shown), ice level sensor 74 (see FIG. 4A), and/or a variety of sensors and/or switches including, but not limited to, pressure transducers, temperature sensors, acoustic sensors, etc. In various embodiments, based on those inputs for example, controller 80 may be able to control compressor 15, condenser fan 18, refrigerant expansion device 19, hot gas valve 24, water inlet valve 52, discharge valve 56, and/or water pump 62, for example, by sending, one or more indications, signals, messages, commands, data, and/or any other information to such components.

An embodiment of a water level measurement system which includes a remote air pressure sensor is described in detail with reference to FIG. 3. It will be understood, however that any type of water level measurement system or sensor may be used in ice maker 10 including, but not limited to, a float sensor, an acoustic sensor, or an electrical continuity sensor without departing from the scope of the disclosure. The water level measurement system illustrated in FIG. 3 includes air fitting 90 disposed in sump 70, pneumatic tube 86 in fluid communication with air fitting 90, and controller 80. Controller 80 may also include, or be coupled to, air pressure sensor 84, which may be used to detect the water pressure proximate bottom 72 of sump 70 wherein the water pressure proximate bottom 72 of sump 70 can be correlated to the water level in sump 70. Using the output from air pressure sensor 84, processor 82 can determine the water level in sump 70. Thus controller 80 can determine a sump empty level. During normal ice making of ice maker 10, air pressure sensor 84 also allows processor 82 to determine the appropriate time at which to initiate an ice harvest cycle, control the fill and purge functions, and to detect any failure modes of components of the water systems of ice maker 10.

In certain embodiments, air pressure sensor 84 may include a piezoresistive transducer comprising a monolithic silicon pressure sensor. The transducer may provide an analog signal to controller 80 with analog to digital (A/D) inputs. Air pressure sensor 84 may use a strain gauge to provide an output signal that is proportional to the applied pressure of water within sump 70. In certain embodiments, air pressure sensor 84 may be a low-cost, high-reliability air pressure transducer, such as part number MPXV5004 from Freescale Semiconductor of Austin, Tex. In other embodiments, controller 80 may also include, or be coupled to, any commercially available device for measuring water level in sump 70 in addition to or in replacement of air pressure sensor 84.

Figure 3:
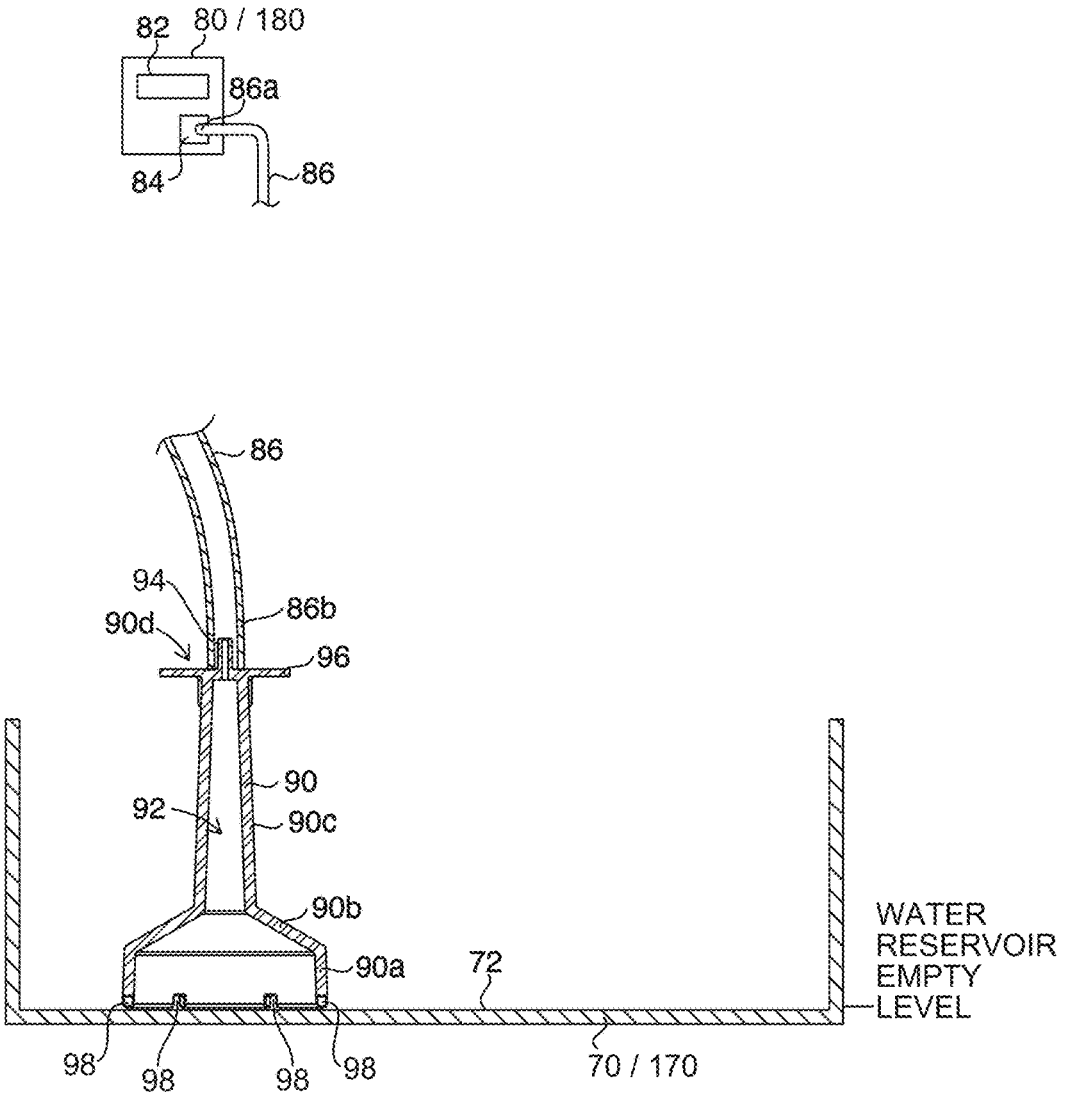
FIG. 3 is a section view of a water level measurement system according to one embodiment of the invention.

With continued reference to FIG. 3, air pressure sensor 84 may be connected to sump 70 by pneumatic tube 86 having a proximal end 86*a* and a distal end 86*b*. Proximal end 86*a* of pneumatic tube 86 is connected to air pressure sensor 84 and distal end 86*b* of pneumatic tube 86 is connected to and in fluid communication with air fitting 90. Air fitting 90 may be positioned in sump 70 and includes base portion 90*a*, first portion 90*b*, second portion 90*c*, and top portion 90*d* all in fluid communication with the water proximate bottom 72 of sump 70. Base portion 90*a*, first portion 90*b*, second portion 90*c*, and top portion 90*d* of air fitting 90 define a chamber 92 in which air may be trapped. One or more openings 98 surround the perimeter of base portion 90*a* allowing the water proximate bottom 72 of sump 70 to be in fluid communication with the air in chamber 92 of air fitting 90. As the water level in sump 70 increases, the pressure of the water proximate bottom 72 of sump 70 is communicated to the air in chamber 92 through the one or more openings 98 of air fitting 90. The air pressure inside chamber 92 increases and this pressure increase is communicated via air through pneumatic tube 86 to air pressure sensor 84. Controller 80 can thus determine the water level in sump 70. Additionally, as the water level in sump 70 decreases, the pressure in chamber 92 also decreases. This pressure decrease is communicated via air through pneumatic tube 86 to air pressure sensor 84. Controller 80 can thus determine the water level in the sump.

Base portion 90*a* of air fitting 90 may be substantially circular and may have a large diameter which may assist in reducing or eliminating capillary action of water inside chamber 92. First portion 90*b* may be substantially conical in shape and accordingly transition between the large diameter of base portion 90*a* to the smaller diameter of second portion 90*c*. Second portion 90*c* may taper from first portion 90*b* to top portion 90*d*. Disposed proximate top portion 90*d* may be a connector 94 to which distal end 86*b* of pneumatic tube 86 is connected. Connector 94 may be any type of pneumatic tubing connector known in the art, including, but not limited to, a barb, a nipple, etc.

Figure 4:
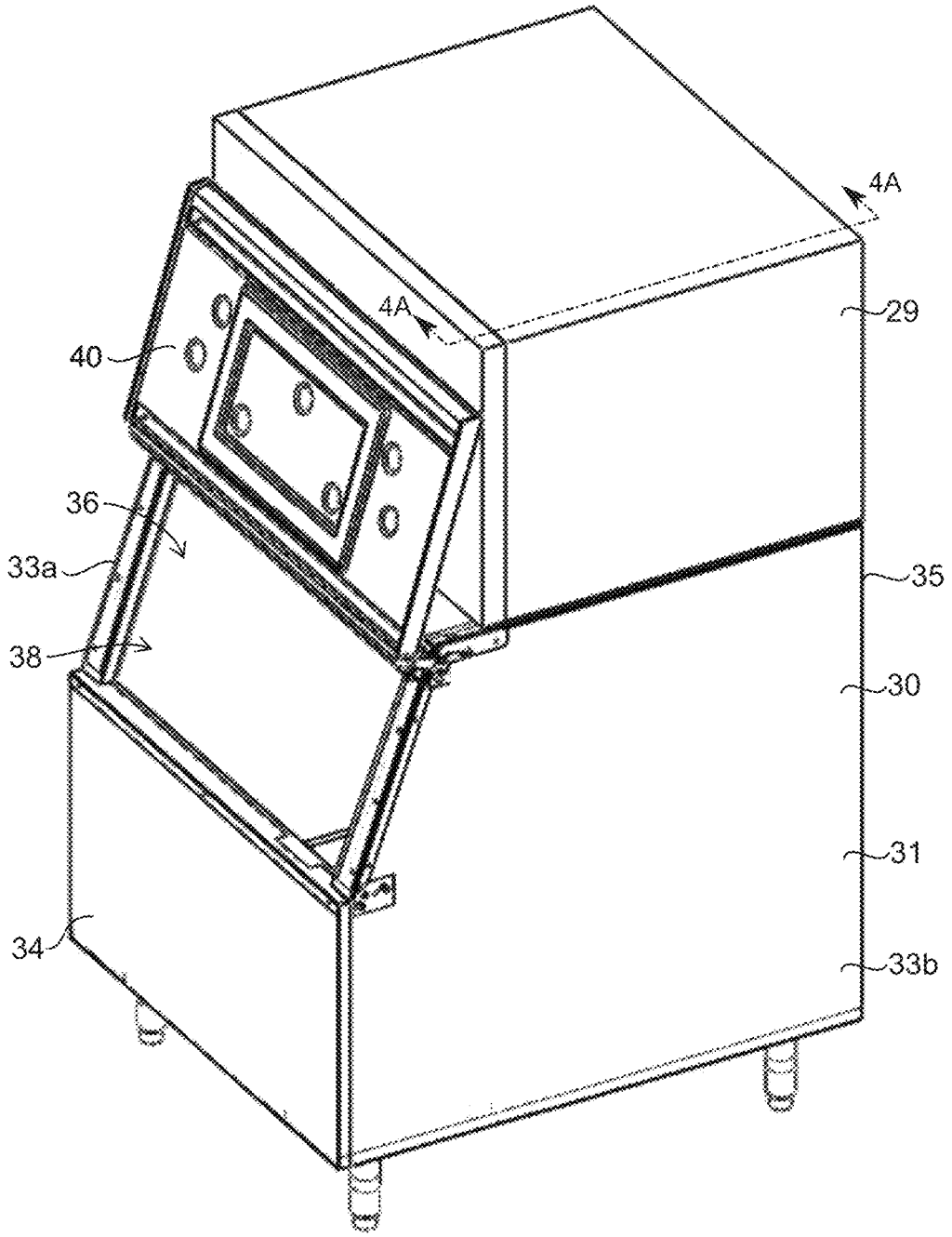
FIG. 4 is a right perspective view of an ice maker within a cabinet wherein the cabinet is on an ice storage bin assembly according to an embodiment of the invention.

In many embodiments, as illustrated in FIG. 4, ice maker 10 may be inside of a cabinet 29 which may be mounted on top of an ice storage bin assembly 30. Cabinet 29 may be closed by suitable fixed and removable panels to provide temperature integrity and compartmental access, as will be understood by those skilled in the art. Ice storage bin assembly 30 includes an ice storage bin 31 having an ice hole (not shown) through which ice produced by ice maker 10 falls. The ice is then stored in cavity 36 until retrieved. Ice storage bin 31 further includes an opening 38 which provides access to the cavity 36 and the ice stored therein. Cavity 36, ice hole (not shown) and opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36.

Figure 4A:
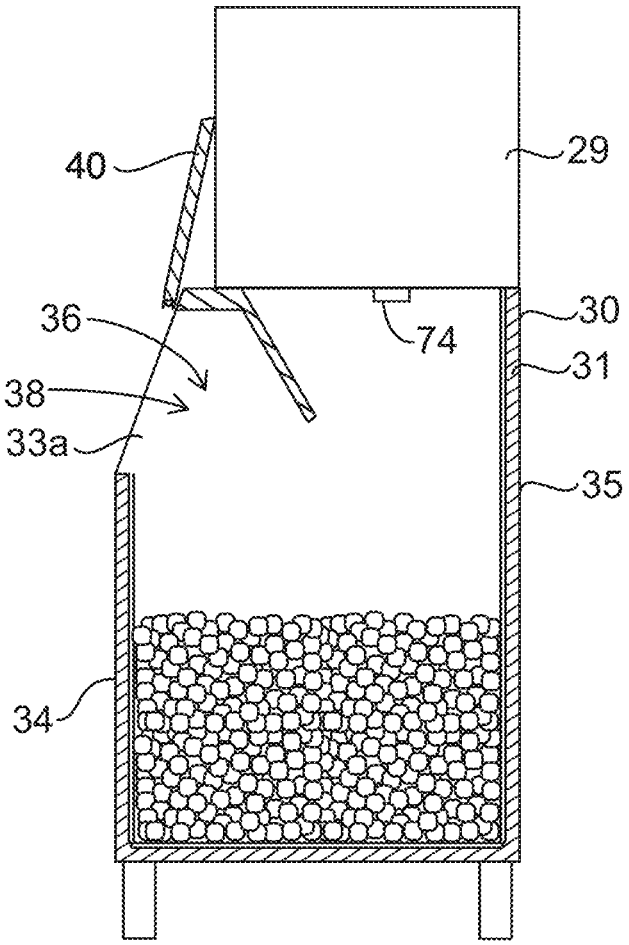
FIG. 4A is a right section view of an ice maker within a cabinet wherein the cabinet is on an ice storage bin assembly according to an embodiment of the invention.

In various embodiments, as shown in FIG. 4A, ice maker 10 includes an ice level sensor 74 to detect when ice storage bin 31 has become full, as is known in the art. Accordingly, ice level sensor 74 may be any type of sensor or switch for determining the level of ice in ice storage bin 31 including, but not limited to, a thermostatic switch, an optical switch, an acoustic switch, a reed switch for sensing the location of a door or flap, a photoelectric eye, a rotation switch, etc. In one embodiment, for example, a door or flap is positioned below ice formation device 20 and when ice is harvested and falls out of freeze plate 22, the falling ice will cause the door or flap to rotate from a first position to a second position. If ice storage bin 31 is full, the ice in ice storage bin 31 will prevent the door or flap from rotating from the second position back to the first position. Accordingly, ice level sensor 74 may include a sensor which can sense the rotation or proximity of the door or flap, such as a rotation sensor or reed switch, respectively. Controller 80 can therefore receive a signal indicating that ice storage bin 31 is full when ice level sensor 74 senses that the door or flap remains in the second position. Additionally, ice level sensor 74 may be used to sense when the ice is harvested from ice formation device 20. Ice level sensor 74 may be located, for example, in ice storage bin 31, on cabinet 29, or in any location known in the art for determining the level of ice in ice storage bin 31. When ice level sensor 74 determines that ice storage bin 31 is full, controller 80 causes ice maker 10 to stop making ice.

Having described each of the individual components of one embodiment of ice maker 10, the manner in which the components interact and operate in various embodiments may now be described in reference again to FIG. 1. During operation of ice maker 10 in an ice making cycle, compressor 15 receives low-pressure, substantially gaseous refrigerant from evaporator 21 through suction line 28*d*, pressurizes the refrigerant, and discharges high-pressure, substantially gaseous refrigerant through discharge line 28*b* to heat rejecting heat exchanger 17, shown as condenser 16. In condenser 16, heat is removed from the refrigerant, causing the substantially gaseous refrigerant to condense into a substantially liquid refrigerant. The substantially liquid refrigerant may include some gas such that the refrigerant is a liquid-gas mixture.

After exiting condenser 16, the high-pressure, substantially liquid refrigerant is routed through liquid line 28*c* to refrigerant expansion device 19, which reduces the pressure of the substantially liquid refrigerant for introduction into evaporator 21. As the low-pressure expanded refrigerant is passed through tubing of evaporator 21, the refrigerant absorbs heat from the tubes contained within evaporator 21 and vaporizes as the refrigerant passes through the tubes. Low-pressure, substantially gaseous refrigerant is discharged from the outlet of evaporator 21 through suction line 28*d*, and is reintroduced into the inlet of compressor 15.

In certain embodiments of the invention, at the start of the ice making cycle, a water fill valve 52 is turned on to supply a mass of water to sump 70 and water pump 62 is turned on. The ice maker will freeze some or all of the mass of water into ice. After the desired mass of water is supplied to sump 70, the water fill valve may be closed. Compressor 15 is turned on to begin the flow of refrigerant through refrigeration system 12. Water pump 62 circulates the water over freeze plate 22 via water line 63 and water distributor 66. The water that is supplied by water pump 62 then begins to cool as it contacts freeze plate 22, returns to water sump 70 below freeze plate 22 and is recirculated by water pump 62 to freeze plate 22. Once the water is sufficiently cold, water flowing across freeze plate 22 starts forming ice cubes. After the ice cubes are formed such that the desired ice cube thickness is reached, water pump 62 is turned off and the harvest portion of the ice making cycle is initiated by opening hot gas valve 24. This allows warm, high-pressure gas from compressor 15 to flow through hot gas bypass line 28*a* to enter evaporator 21, thereby harvesting the ice by warming freeze plate 22 to melt the formed ice to a degree such that the ice may be released from freeze plate 22 and falls into ice storage bin 31 where the ice can be temporarily stored and later retrieved. Hot gas valve 24 is then closed, terminating the harvest portion of the ice making cycle, and the ice making cycle can then repeat.

Figure 5:
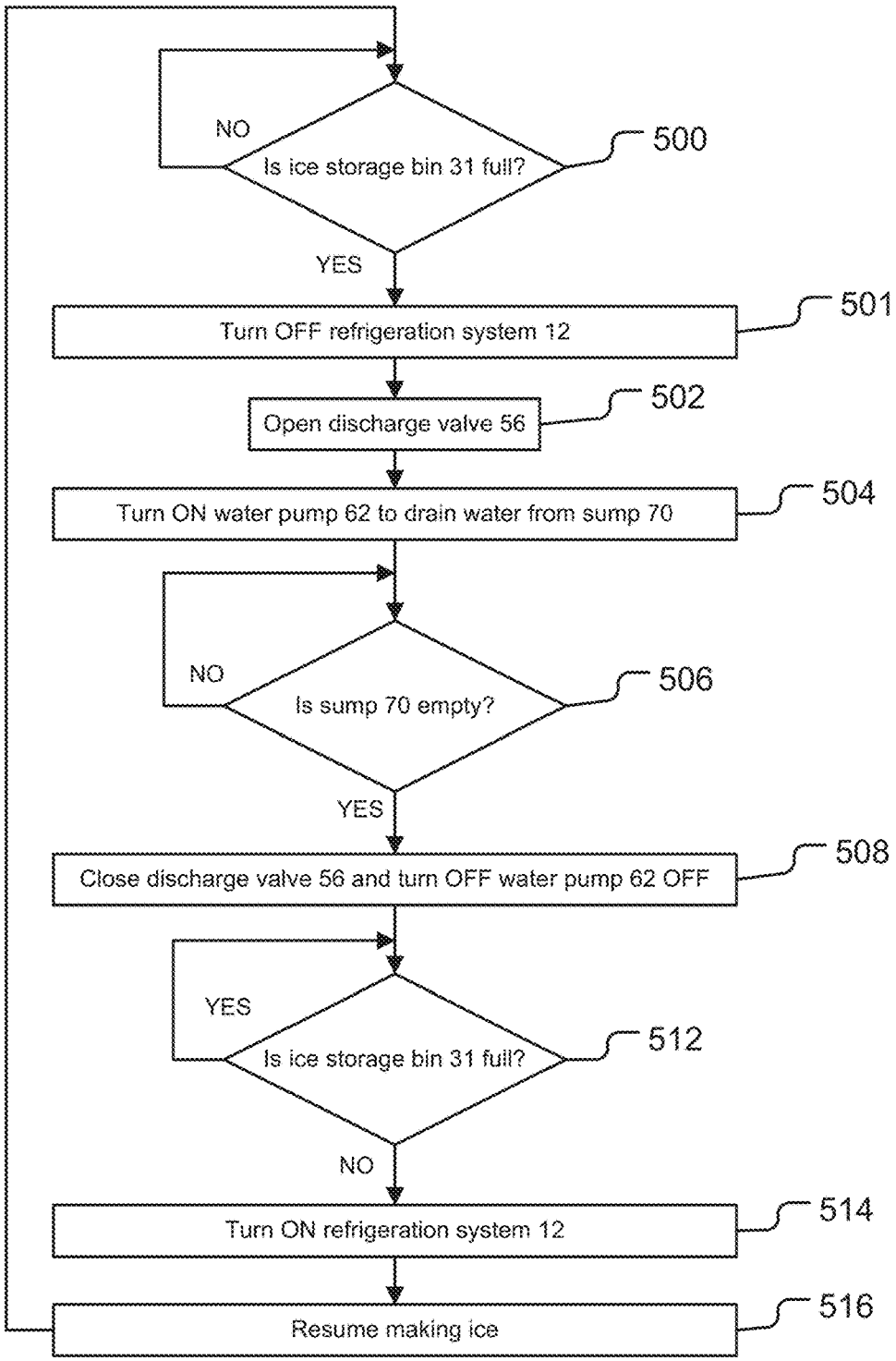
FIG. 5 is flow chart describing the operation of an ice maker according to the first embodiment of the invention.

This cycle continues until ice level sensor 74 senses that ice storage bin 31 is full of ice at which point the refrigeration system of typical ice makers is turned off. However, in various embodiments of ice maker 10, sump 70 is drained of all or substantially all of the water remaining in sump 70 when the ice storage bin 31 becomes full of ice. Thus, referring to FIG. 5, a method of operating ice maker 10 is illustrated. At step 500, ice level sensor 74 monitors or senses the level of ice in ice storage bin 31. When controller 80 receives an indication or signal from ice level sensor 74 that ice storage bin 31 is full, or controller 80 determines from signals or data from ice level sensor 74 that ice storage bin 31 is full, controller 80 sends an indication or signal to refrigeration system 12 to turn OFF at step 501, and controller 80 sends an indication or signal to discharge valve 56 at step 502 which causes or signals to discharge valve 56 to open. At step 504, controller 80 sends an indication or signal to water pump 62 to turn ON. Water pump 62 then pumps or drains the water from sump 70 through the open discharge valve 56. Discharge valve 56 and water pump 62 remain open and ON, respectively, at step 506 until sump 70 is empty. During step 506, controller 80 may be continuously sending indications or signals to discharge valve 56 and/or water pump 62 to remain open and ON, or discharge valve 56 and/or water pump 62 may remain open and ON until controller 80 sends an indication or signal to close or turn OFF.

Sump 70 is empty when all or substantially all of the water has been drained from sump 70. In certain embodiments, for example, the amount of time it takes for sump 70 to empty may be calculated and/or empirically measured. Therefore, discharge valve 56 and water pump 62 may remain open and ON, respectively, at step 506 for an amount of time that allows for all or substantially all of the water to drain from sump 70. In various embodiments, for example, the period of time for sump 70 to empty may be from about 30 seconds to about 5 minutes (e.g., about 30 seconds, about 1 minute, about 1.5 minutes, about 2 minutes, about 2.5 minutes, about 3 minutes, about 3.5 minutes, about 4 minutes, about 4.5 minutes, about 5 minutes). In other embodiments, a water level sensor 84 may monitor or sense the level of water in sump 70 so that water level sensor or controller 80 may to determine when sump 70 is empty. Thus, in such embodiments, discharge valve 56 and water pump 62 may remain open and ON, respectively, at step 506 until sump 70 is empty as determined or indicated by the water level sensor 84.

When sump 70 has been emptied, either after a period of time has expired or after a water level sensor 84 determines or indicates that sump 70 has been emptied, at step 508, controller 80 sends an indication or signal to water pump 62 to turn OFF and sends an indication or signal to discharge valve 56 to close. At step 512, ice level sensor 74 periodically or continuously monitors the level of ice in ice storage bin 31. When controller 80 receives an indication or signal from ice level sensor 74 that ice storage bin 31 is less than full, or controller 80 determines from signals or data from ice level sensor 74 that ice storage bin 31 is less than full, controller 80 sends an indication or signal to refrigeration system 12 to turn ON at step 514. Ice maker 10 will then resume making ice at step 516. This method may then cycle back to step 500.

Although, ice maker 10 has been described as utilizing water pump 62 and discharge valve 56 to drain water from sump 70 when ice storage bin 31 is full, in alternative embodiments, the discharge valve is located in the lowest part of sump 70. When ice storage bin 31 is full, controller 80 will cause the discharge valve to open thereby permitting all or substantially all of the water in sump 70 to drain by gravity from sump 70. In yet other embodiments, ice maker 10 may include one or more discharge valves. For example, one discharge valve may be located in the lowest part of sump 70 and a second discharge valve may be in fluid communication with water pump 62. Accordingly, water can be drained out via the first discharge valve and pumped out via the second discharge valve. Therefore, in various embodiments, all or substantially all of the water in sump 70 may be removed by pumping and/or draining water through one or more discharge valves.

In other embodiments, for example, discharge valve 56 may be a valve that is open when it is not powered. That is, when refrigeration system 12 is turned off, discharge valve 56 remains open. Thus, in an alternative method of operation, when ice level sensor 74 senses that ice storage bin 31 is full, controller 80 causes discharge valve 56 to open. Water then begins to drain from sump 70. Controller 80 then causes refrigeration system 12 to turn OFF and discharge valve 56 remains open. Accordingly, all or substantially all of the water may drain from sump 70 when refrigeration system 12 is OFF. Therefore, in various embodiments, at step 508, controller 80 may send an indication or signal to water pump 62 to turn OFF and discharge valve 56 may be kept open or may remain open. That is, even after refrigeration system 12 and water pump 62 are turned OFF, discharge valve 56 is open. Discharge valve 56 may be kept open or may remain open until refrigeration system is turned back on at step 514, at which point controller 80 may also send an indication or signal to discharge valve 56 to close so sump 70 can refill with fresh water.

In yet another embodiment, for example, discharge valve 56 may be a valve that remains open for a period of time after refrigeration system 12 is turned OFF. That is, when refrigeration system 12 is turned off, discharge valve 56 remains open for a period of time that allows for all or substantially all of the water to drain from sump 70. Thus, in an alternative method of operation, when ice level sensor 74 senses that ice storage bin 31 is full, controller 80 causes discharge valve 56 to open. Water then begins to drain from sump 70. Controller 80 then causes refrigeration system 12 to turn OFF and discharge valve 56 remains open for a period of time. Accordingly, all or substantially all of the water may drain from sump 70 when refrigeration system 12 is OFF. After the period of time expires, controller 80 causes discharge valve 56 to close.

Accordingly, by draining all or substantially all of the water from sump 70 in ice maker 10 when ice storage bin 31 becomes full, there is little or no water remaining in sump 70 which can warm up while refrigeration system 12 of ice maker 10 is off. This greatly reduces or eliminates the possibility for harmful bacteria, parasites, organisms, and/or other biological material, including but not limited to *Legionella*, to grow while ice maker 10 is not producing ice. Thus, when ice storage bin 31 is no longer full and ice maker 10 resumes making ice, the ice produced will not include harmful bacteria, parasites, organisms, and/or other biological material.

Flake-Type or Nugget-Type Ice Maker

Figure 6:
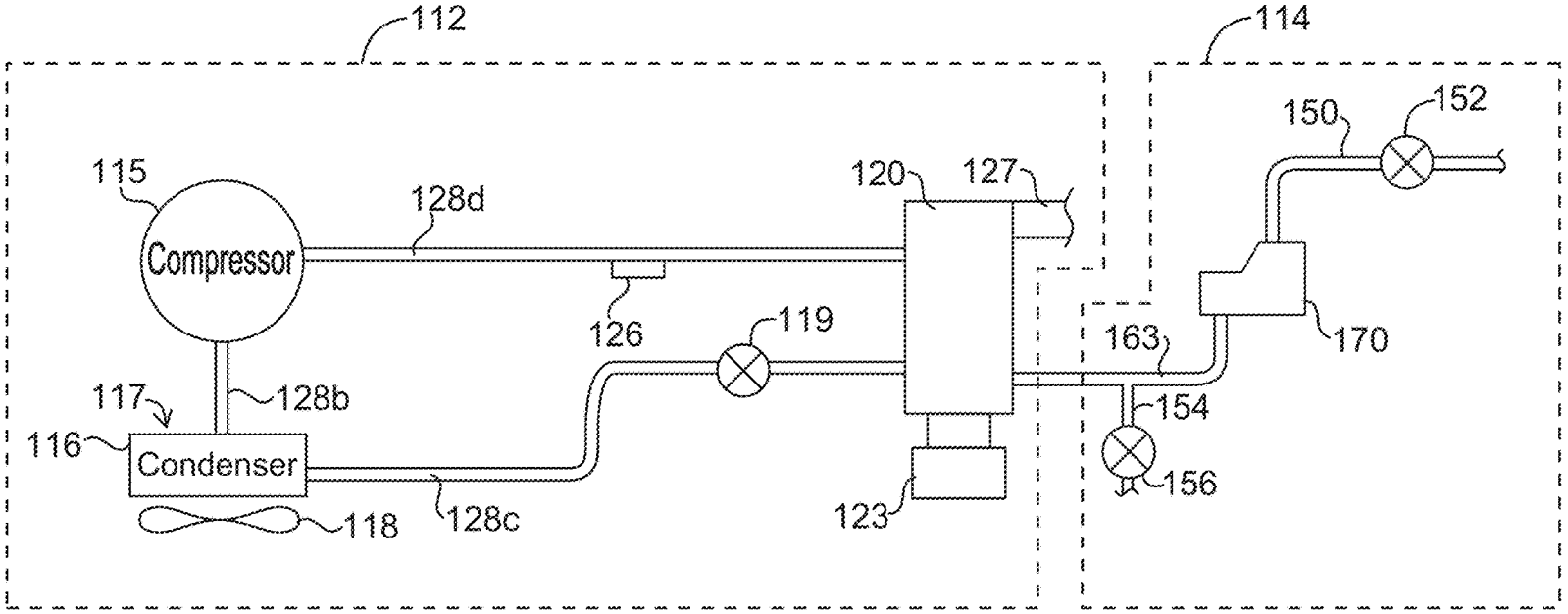
FIG. 6 is a schematic drawing of an ice maker having various components according to a second embodiment of the invention.

FIG. 6 illustrates certain principal components of another embodiment of ice maker 110 having a refrigeration system 112 and water system 114. Ice maker 110 produces flake or nugget-type ice. The refrigeration system 112 of ice maker 110 may include compressor 115, heat rejecting heat exchanger 117, refrigerant expansion device 119 for lowering the temperature and pressure of the refrigerant, and ice formation device 120. As shown, it will be understood that heat rejecting heat exchanger 117 may be condenser 16 for condensing compressed refrigerant vapor discharged from the compressor 115. However, in other embodiments, for example, in refrigeration systems that utilize carbon dioxide refrigerants where the heat of rejection is trans-critical, heat rejecting heat exchanger 117 is able to reject heat from the refrigerant without condensing the refrigerant. Ice produced by ice maker 110 is produced in ice formation device 120, the structure and operation of which is described more fully elsewhere herein.

Refrigerant expansion device 119 may include, but is not limited to, a capillary tube, a thermostatic expansion valve or an electronic expansion valve. In certain embodiments, where refrigerant expansion device 119 is a thermostatic expansion valve or an electronic expansion valve, ice maker 110 may also include a temperature sensing bulb 126 placed at the outlet of the evaporator 121 to control refrigerant expansion device 119. In other embodiments, where refrigerant expansion device 119 is an electronic expansion valve, ice maker 110 may also include a pressure sensor (not shown) placed at the outlet of the ice formation device 121 to control refrigerant expansion device 119 as is known in the art. In certain embodiments that utilize a gaseous cooling medium (e.g., air) to provide condenser cooling, a condenser fan 118 may be positioned to blow the gaseous cooling medium across condenser 116. As described more fully elsewhere herein, a form of refrigerant cycles through these components via refrigerant lines 128*b*, 128*c*, 128*d*.

The water system 114 of ice maker 110 includes water line 163 and water reservoir or float chamber 170 adapted to hold water. Water system 114 of ice maker 110 further includes water supply line 150 and water inlet valve 152 disposed thereon for providing water to float chamber 170 with water from a water source (not shown), wherein some or all of the supplied water may be frozen into ice. Float valve 172 (see FIG. 7) in float chamber 170 controls the water level in ice making chamber 122. Water system 114 of ice maker 110 further includes discharge line 154 and discharge valve 156 disposed thereon. Water and/or any contaminants remaining in float chamber 170 and ice formation device 120 after ice has been formed may be drained via discharge line 154 and discharge valve 156. In various embodiments, discharge line 154 may be in fluid communication with water line 163. Accordingly, water in float chamber 170 and ice formation device 120 may be drained from float chamber 170 and ice formation device 120 by opening discharge valve 156. As described more fully elsewhere herein, when discharge valve 156 is opened, all or substantially all of the water in float chamber 170 and ice formation device 120 can be removed from ice maker 110 when an ice storage bin is full.

Figure 7:
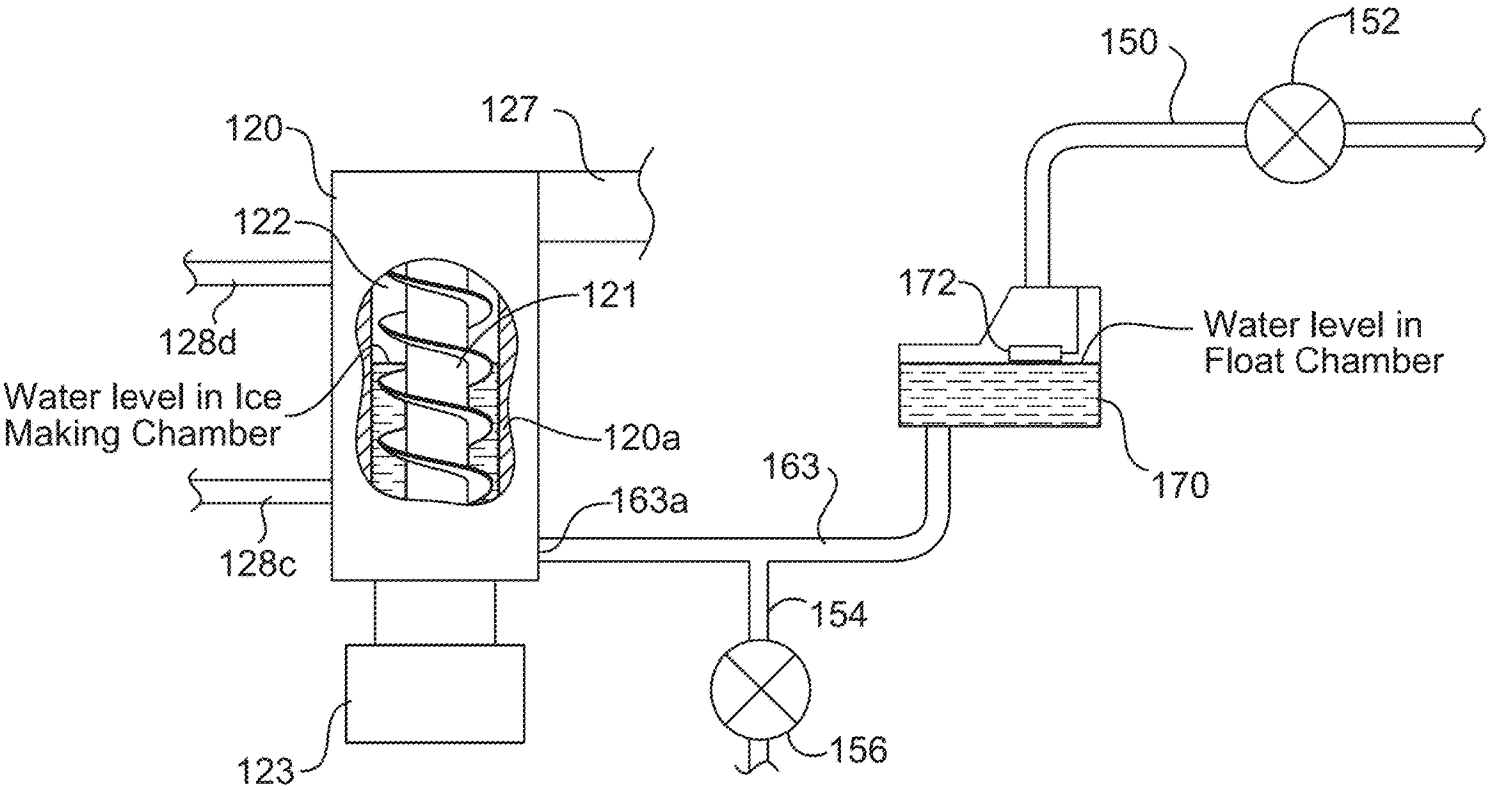
FIG. 7 is a schematic drawing of an ice maker having various components according to the second embodiment of the invention.

Referring now to FIG. 7, ice formation device 120 is described in detail. Ice formation device 120 includes a substantially cylindrical ice making chamber 122 surrounded by an evaporator (not shown) formed of a refrigerant line coiling around ice making chamber 122. The refrigerant line is in fluid communication with liquid line 128*c* and suction line 128*d*. The refrigerant line enters ice formation device 120 proximate a lower portion of ice making chamber 122, coils upward around ice making chamber 122, and exits ice formation device 120 proximate an upper portion of ice making chamber 122. Accordingly, the refrigerant in the refrigerant line warms as it rises in ice making chamber 122. Ice making chamber 122 and the refrigerant line is insulated by insulating foam or an insulated housing 120*a*. In certain embodiments, for example, ice making chamber 122 may be a brass or stainless steel tube.

Ice formation device 120 further includes an auger 121 coaxially located within substantially cylindrical ice making chamber 122. Auger 121 has a diameter slightly less than the diameter of ice making chamber 122. Therefore, as auger 121 is rotated by auger motor 123, auger 121 removes a substantial amount of the ice that forms on the inside of ice making chamber 122. The formed ice exits ice making chamber 120 out ice outlet 127. The direction of rotation of auger flight 121 causes ice that is formed on the inside of ice making chamber 122 to be lifted up toward the upper portion of ice making chamber 122. Water to be frozen into ice is supplied to ice making chamber by a water supply inlet 163*a* located proximate the lower end of ice formation device 120. Water supply inlet 163*a*, float chamber 170, and discharge valve 156 are in fluid communication by water line 163.

Figure 8:
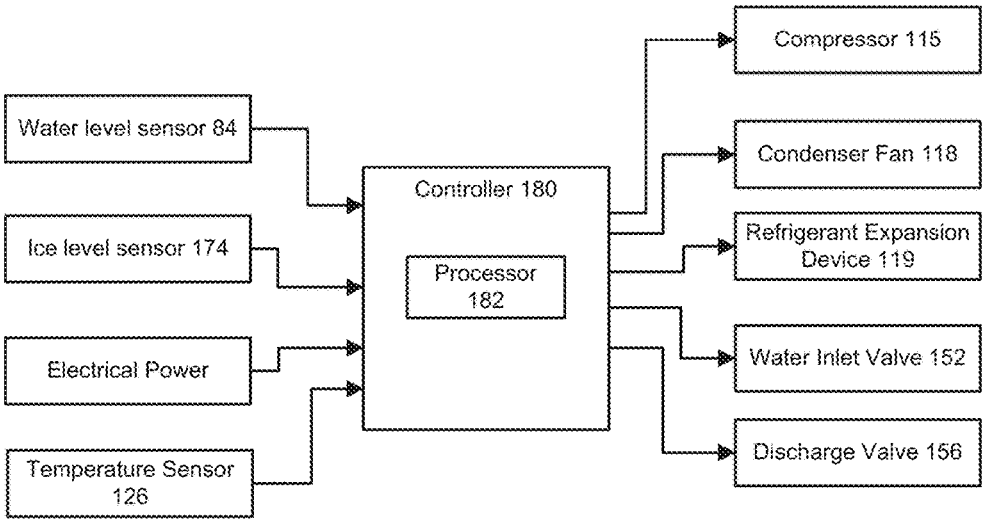
FIG. 8 is a schematic drawing of a controller for controlling the operation of the various components of an ice maker according to the second embodiment of the invention.

Referring now to FIG. 8, ice maker 110 may also include a controller 180. Controller 180 may be located remote from ice formation device 120 and float chamber 170. Controller 180 may include a processor 182 for controlling the operation of ice maker 110 including the various components of refrigeration system 112 and water system 114. Processor 182 of controller 180 may include a non-transitory processor-readable medium storing code representing instructions to cause processor 182 to perform a process. Processor 182 may be, for example, a commercially available microprocessor, an application-specific integrated circuit (ASIC) or a combination of ASICs, which are designed to achieve one or more specific functions, or enable one or more specific devices or applications. In yet another embodiment, controller 180 may be an analog or digital circuit, or a combination of multiple circuits. Controller 180 may also include one or more memory components (not shown) for storing data in a form retrievable by controller 180. Controller 180 can store data in or retrieve data from the one or more memory components.

In various embodiments, controller 180 may also comprise input/output (I/O) components (not shown) to communicate with and/or control the various components of ice maker 110. In certain embodiments, for example, controller 180 may receive inputs from, an electrical power source (not shown), ice level sensor 74, and/or a variety of sensors and/or switches including, but not limited to, pressure transducers, temperature sensors, acoustic sensors, etc. In yet other embodiments, for example, controller 180 may receive inputs from an optional water reservoir water level sensor 84 or system (see FIG. 3). In various embodiments, based on those inputs for example, controller 180 may be able to control compressor 115, condenser fan 118, refrigerant expansion device 119, water inlet valve 152, and/or discharge valve 156, by sending, for example, one or more indications, signals, messages, commands, data, and/or any other information to such components.

With reference again to FIG. 4, in many embodiments ice maker 110 may be inside of a cabinet 29 which may be mounted on top of an ice storage bin assembly 30 in a manner similar to ice maker 10 as described herein. Cabinet 29 may be closed by suitable fixed and removable panels to provide temperature integrity and compartmental access, as will be understood by those skilled in the art. Ice storage bin assembly 30 includes an ice storage bin 31 having an ice hole (not shown) through which ice produced by ice maker 10 falls. The ice is then stored in cavity 36 until retrieved. Ice storage bin 31 further includes an opening 38 which provides access to the cavity 36 and the ice stored therein. Cavity 36, ice hole (not shown) and opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36.

In various embodiments, as shown in FIG. 4A, ice maker 110 includes an ice level sensor 74 to detect when ice storage bin 31 has become full, as is known in the art. Accordingly, ice level sensor 74 may be any type and/or construction of sensor or switch for determining the level of ice in ice storage bin 31 including, but not limited to, a thermostatic switch, an optical switch, an acoustic switch, a reed switch for sensing the location of a door or flap, a photoelectric eye, a rotation switch, etc. Ice level sensor 74 may be located, for example, in ice storage bin 31, on cabinet 29, or in any location known in the art for determining the level of ice in ice storage bin 31. When ice level sensor 74 determines that ice storage bin 31 is full, controller causes ice maker 110 to stop making ice.

It will be understood that many of the components of ice maker 110 may be substantially similar or identical to many components of ice maker 10. Accordingly, it will be understood that the various components of ice maker 110 may be similar in construction and/or operation to the corresponding components of ice maker 10 as described above. Ice maker 110 and ice maker 10 may have other conventional components not described herein without departing from the scope of the invention.

Having described each of the individual components of one embodiment of ice maker 110, the manner in which the components interact and operate in various embodiments may now be described in reference again to FIGS. 6 and 7. During operation of ice maker 110 in an ice making cycle, compressor 115 receives low-pressure, substantially gaseous refrigerant from ice formation device 120 through suction line 128*d*, pressurizes the refrigerant, and discharges high-pressure, substantially gaseous refrigerant through discharge line 128*b* to condenser 116. In condenser 116, heat is removed from the refrigerant, causing the substantially gaseous refrigerant to condense into a substantially liquid refrigerant. The substantially liquid refrigerant may include some gas such that the refrigerant is a liquid-gas mixture.

After exiting condenser 116, the high-pressure, substantially liquid refrigerant is routed through liquid line 128*c* to refrigerant expansion device 119, which reduces the pressure of the substantially liquid refrigerant for introduction into ice formation device 120. As the low-pressure expanded refrigerant is passed through tubing of the evaporator (not shown) in ice formation device 120, the refrigerant absorbs heat from ice formation device 120 and vaporizes as the refrigerant passes through the tubes. This cools ice making chamber 122 of ice formation device 120. Low-pressure, substantially gaseous refrigerant is discharged from the outlet of ice formation device 120 through suction line 128*d*, and is reintroduced into the inlet of compressor 115.

In certain embodiments of the invention, during ice making a water fill valve 152 is turned on to supply water to float chamber 170. Water that is supplied to float chamber 170 flows through water line 163 and into ice making chamber 122 of ice formation device 120. The supplied water typically travels from float chamber 170 into ice making chamber 122 by gravity flow. The water level in ice making chamber 122 is typically equal to the height of the water in float chamber 170. Preferably, the water level in ice making chamber 122 is controlled by float valve 172 in float chamber 170. As cold refrigerant passes through evaporator (not shown) of ice formation device 120 the water in ice making chamber 122 freezes inside ice making chamber 122. Auger 121 continuously rotates to scrape the layer of ice formed on the inner wall of ice making chamber 122 and conveys the formed ice upward. The formed ice exits ice formation device 120 via ice outlet 127 where it may then be deposited into ice storage bin 31. It will be understood that ice maker 110 may include other elements known in the art for forming flake or nugget-type ice without departing from the scope of the invention. For example, embodiments of ice maker 110 may also include a nugget formation device (not shown) located proximate the top of auger flight 121 which compacts and extrudes the formed ice through small passageways thereby compacting and reducing the water content of the formed ice. As the compacted ice exits the ice formation device 120 it is forced around a corner causing the ice to break into smaller pieces (nuggets) of ice.

Figure 9:
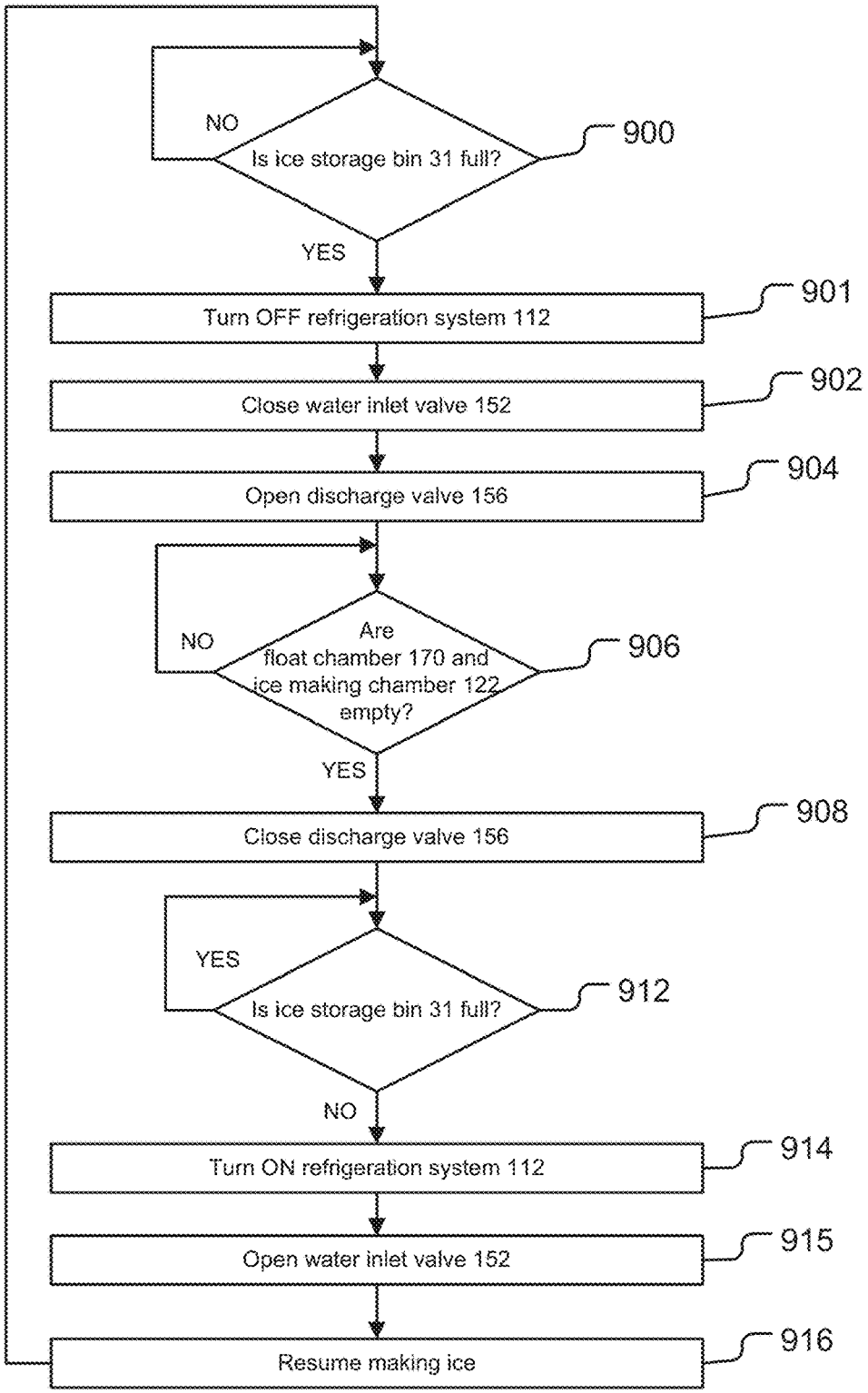
FIG. 9 is flow chart describing the operation of an ice maker according to the second embodiment of the invention.

Ice maker 110 may continue to make ice until ice level sensor 74 senses that ice storage bin 31 is full of ice at which point the refrigeration system of typical ice makers is turned off. However, in various embodiments of ice maker 110, float chamber 170 and ice making chamber 122 are drained of all or substantially all of the water remaining in float chamber 170 and ice making chamber 122 when ice storage bin 31 becomes full of ice. Thus, referring to FIG. 9, a method of operating ice maker 110 is illustrated. At step 900, ice level sensor 74 monitors or senses the level of ice in ice storage bin 31. When controller 180 receives an indication or signal from ice level sensor 74 that ice storage bin 31 is full, or controller 180 determines from signals or data from ice level sensor 74 that ice storage bin 31 is full, controller 180 sends an indication or signal to refrigeration system 12 to turn OFF at step 910, and controller 180 sends an indication or signal to water inlet valve 152 at step 902 which causes or signals to water inlet valve 152 to close. Additionally, at step 904, controller 180 sends an indication or signal to discharge valve 156 which causes or signals to discharge valve 156 to open. Water then begins to drain from float chamber 170 and ice making chamber 122. Discharge valve 156 remains open at step 906 until float chamber 170 and ice making chamber 122 are empty. During step 906, controller 80 may be continuously sending indications or signals to discharge valve 156 to remain open, or discharge valve 156 may remain open until controller 80 sends an indication or signal to close or turn OFF. Float chamber 170 and ice making chamber 122 are empty when all or substantially all of the water has been drained from float chamber 170 and ice making chamber 122.

In certain embodiments, for example, the amount of time it takes for float chamber 170 and ice making chamber 122 to empty may be calculated and/or empirically measured. Therefore, discharge valve 156 may remain open at step 906 for an amount of time that allows for all or substantially all of the water to drain from float chamber 170 and ice making chamber 122. In various embodiments, for example, the period of time for float chamber 170 and ice making chamber 122 to empty may be from about 30 seconds to about 5 minutes (e.g., about 30 seconds, about 1 minute, about 1.5 minutes, about 2 minutes, about 2.5 minutes, about 3 minutes, about 3.5 minutes, about 4 minutes, about 4.5 minutes, about 5 minutes). In other embodiments, an optional water level sensor 84 (see FIG. 3) may monitor or sense the level of water in float chamber 170 so that water level sensor 84 or controller 80 may to determine when float chamber 170 and ice making chamber 122 are empty. Thus, in such embodiments, discharge valve 156 may remain open at step 906 until float chamber 170 and ice making chamber 122 are empty as determined or indicated by the water level sensor 84.

When float chamber 170 and ice making chamber 122 have been emptied, either after a period of time has expired or after a water level sensor 84 determines or indicates that float chamber 170 and ice making chamber 122 have been emptied, at step 908, controller 180 sends an indication or signal to discharge valve 156 to close. At step 912, ice level sensor 174 periodically or continuously monitors the level of ice in ice storage bin 31. When controller 80 receives an indication or signal from ice level sensor 74 that ice storage bin 31 is less than full, or controller 80 determines from signals or data from ice level sensor 74 that ice storage bin 31 is less than full, controller 180 sends an indication or signal to refrigeration system 12 to turn ON at step 914 and controller 180 sends an indication or signal to water inlet valve 152 to OPEN at step 915 to refill float chamber 170 and ice making chamber 122. Ice maker 110 will then resume making ice at step 916. This method may then cycle back to step 900.

In other embodiments, for example, discharge valve 156 may be a valve that is open when it is not powered. That is, when refrigeration system 112 is turned off, discharge valve 156 remains open. Thus, in an alternative method of operation, when ice level sensor 174 senses that ice storage bin 31 is full, controller 180 causes water inlet valve 152 to close and causes discharge valve 156 to open. Water then begins to drain from float chamber 170 and ice making chamber 122. Controller 180 then causes refrigeration system 112 to turn OFF and discharge valve 156 remains open. Accordingly, all or substantially all of the water may drain from float chamber 170 and ice making chamber 122 when refrigeration system 112 is OFF. Therefore, in various embodiments, at step 908, discharge valve 56 may be kept open or remains open. That is, even after refrigeration system 112 is turned OFF, discharge valve 156 is open. Discharge valve 156 may be kept open or may remain open until refrigeration system is turned back on at step 914, at which point controller 180 may also send an indication or signal to discharge valve 156 to close so float chamber 170 can refill with fresh water.

In yet another embodiment, for example, discharge valve 156 may be a valve that remains open for a period of time after refrigeration system 112 is turned OFF. That is, when refrigeration system 112 is turned off, discharge valve 156 remains open for a period of time that allows for all or substantially all of the water to drain from float chamber 170 and ice making chamber 122. Thus, in an alternative method of operation, when ice level sensor 174 senses that ice storage bin 31 is full, controller 180 causes water inlet valve 152 to close and causes discharge valve 156 to open. Water then begins to drain from float chamber 170 and ice making chamber 122. Controller 180 then causes refrigeration system 112 to turn OFF and discharge valve 156 remains open for a period of time. Accordingly, all or substantially all of the water may drain from float chamber 170 and ice making chamber 122 when refrigeration system 112 is OFF. After the period of time expires, controller 180 causes discharge valve 156 to close.

Accordingly, by draining all or substantially all of the water from float chamber 170 and ice making chamber 122 in ice maker 110 when ice storage bin 31 becomes full, there is little or no water remaining in float chamber 170 or ice making chamber 122 which can warm up while refrigeration system 112 of ice maker 110 is off. This greatly reduces or eliminates the possibility for harmful bacteria, parasites, organisms, and/or other biological material, including but not limited to *Legionella*, to grow while ice maker 110 is not producing ice. Thus, when ice storage bin 31 is no longer full and ice maker 110 resumes making ice, the ice produced will not include harmful bacteria, parasites, organisms, and/or other biological material.

While various steps are described herein in one order, it will be understood that other embodiments of the method can be carried out in any order and/or without all of the described steps without departing from the scope of the invention.

Thus, there has been shown and described novel methods and apparatuses of an ice maker wherein when the ice harvest bin is full, all or substantially all of the water remaining in the water system is drained. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

What is claimed:

1. An ice maker for forming ice, the ice maker comprising:

(i) a refrigeration system comprising a compressor and an ice formation device;

(ii) a water system for supplying water to the ice formation device, the water system comprising a water pump and a water reservoir adapted to hold water to be formed into ice and a discharge valve in fluid communication with the water reservoir;

(iii) an ice storage bin for storing the formed ice; and (iv) a control system comprising an ice level sensor adapted to sense whether the ice storage bin is full of ice, a water level sensor adapted to sense a water level in the water reservoir, and a controller adapted to cause the discharge valve to open and to cause the water pump to pump water out of the water reservoir through the discharge valve to allow water to drain from the water reservoir based upon an indication from the ice level sensor that the ice storage bin is full of ice, cause the discharge valve to close and to stop the water pump based on an indication from the water level sensor that the water reservoir is empty;

wherein the water level sensor includes a pressure sensor and a fitting;

wherein the fitting comprises a base portion and a tapered portion that tapers as it extends upward from the base portion toward a top of the fitting; and wherein the tapered portion includes a bottom tapered portion and a top tapered portion and the bottom tapered portion is more tapered than the top tapered portion.

2. The ice maker of claim 1, wherein the ice formation device comprises:

an ice making chamber; and an auger within the ice making chamber for removing ice formed in the ice making chamber.

3. The ice maker of claim 1, wherein the ice formation device comprises an evaporator and a freeze plate thermally coupled to the evaporator.

4. A method of controlling an ice maker, the ice maker comprising (i) a refrigeration system comprising a compressor and an ice formation device, (ii) a water system for supplying water to the ice formation device, the water system comprising a water reservoir adapted to hold water to be formed into ice and a discharge valve in fluid communication with the water reservoir, (iii) an ice storage bin for storing the formed ice; and (iv) a control system comprising an ice level sensor adapted to sense whether the ice storage bin is full of ice, a water level sensor adapted to sense a water level in the water reservoir, and a controller adapted to control the operation of the refrigeration system and the water system, the method comprising:

receiving, by the controller, an indication from the ice level sensor that the ice storage bin is full of ice;

causing, by the controller, the compressor to turn off;

causing, by the controller, the discharge valve to open to drain water from the water reservoir;

receiving, by the controller, an indication from the water level sensor that the water reservoir is empty; and causing, by the controller, the discharge valve to close and based on the indication from the water level sensor that the water reservoir is empty;

wherein the water level sensor includes a pressure sensor and a fitting;

wherein the fitting comprises a base portion and a tapered portion that tapers as it extends upward from the base portion toward a top of the fitting; and wherein the tapered portion includes a bottom tapered portion and a top tapered portion and the bottom tapered portion is more tapered than the top tapered portion.

5. The method of claim 4, further comprising:

causing, by the controller, a water pump to turn on to pump water from the water reservoir through the discharge valve.

6. The method of claim 4, further comprising the steps of:

receiving, by the controller, an indication from the ice level sensor that the ice storage bin is not full of ice; and causing, by the controller, the compressor to turn on.

7. The method of claim 4, wherein the ice formation device comprises an ice making chamber, and wherein the step of opening the discharge valve causes water to drain from the ice making chamber.

* * * * *